US006427286B1

(12) United States Patent
Erskine

(10) Patent No.: US 6,427,286 B1
(45) Date of Patent: Aug. 6, 2002

(54) ADJUSTING A SLIDING DOOR

(75) Inventor: Edward J. Erskine, Benson, NY (US)

(73) Assignee: Nelson A Taylor Co., Inc., Gloversville, NY (US)

( * ) Notice: Subject to any disclaimer, the term of this patent is extended or adjusted under 35 U.S.C. 154(b) by 0 days.

(21) Appl. No.: 09/562,900

(22) Filed: May 2, 2000

(51) Int. Cl.[7] ..... E05D 15/16

(52) U.S. Cl. ..... 16/96 R; 16/97; 16/94 R; 16/93 R; 16/90; 49/40; 49/452

(58) Field of Search ..... 16/96 R, 97, 101, 16/102, 105, 106, 94 R, 93 R, 90, 91; 49/40, 404, 436, 440, 425, 426, 423, 452

(56) References Cited

U.S. PATENT DOCUMENTS

| | | | | |
|---|---|---|---|---|
| 2,843,872 | A | * | 7/1958 | Hannon |
| 4,084,289 | A | * | 4/1978 | Naimo |
| 4,104,829 | A | * | 8/1978 | Agcaoili |
| 4,123,874 | A | * | 11/1978 | Scott |
| 4,680,828 | A | * | 7/1987 | Cook |
| 4,823,511 | A | | 4/1989 | Herliczek et al. |
| 4,833,829 | A | | 5/1989 | Wilson |
| 4,912,807 | A | | 4/1990 | Futch et al. |
| 5,224,297 | A | | 7/1993 | Watkins |
| 5,343,594 | A | * | 9/1994 | Harvey |
| 5,724,770 | A | * | 3/1998 | McAfee |

* cited by examiner

*Primary Examiner*—Anthony Knight
*Assistant Examiner*—Mark Williams
(74) *Attorney, Agent, or Firm*—Nixon & Vanderhye P.C.

(57) ABSTRACT

A track system for a movable panel, such as a companionway door on a boat, allows adjustment after installation of the tracks for the panel, and allows the panel to be removed without removing the tracks. Typically a number of adjustable slide block assemblies are utilized each including a slide block of a low friction material (or a wheel on a shaft with a ball bearing mount) and a panel mounting element, the position of the slide block being adjustable with respect to the panel mounting element in a dimension non-aligned with the dimension of the elongation of the tracks. The slide block assembly typically includes an adjuster track including a nut-receiving channel, and removably connected to the slide block, an elongated substantially rectangular prism nut received in the nut-receiving channel; and a number of guide surfaces on the panel mounting element, and cooperating guide surfaces on the adjuster track so that the adjuster track is slidable with respect to the panel mounting element and nut to adjust the position of the panel mounting element with respect to the slide block; and a screw engaging the nut and movable from a tightened position in which the adjuster track is prevented from moving with respect to the panel mounting element, to an adjusting position in which the adjuster track can be moved with respect to the panel mounting element.

25 Claims, 5 Drawing Sheets

ADJUSTING A SLIDING DOOR

BACKGROUND AND SUMMARY OF THE INVENTION

In the installation of movable panels, such as windows, and doors, particularly companionway doors on boats, such as shown in U.S. Pat. Nos. 5,224,297 and 4,833,829 (the disclosures of which are hereby incorporated by reference herein) it is highly desirable to be able to adjust the panel with respect to the track during or after track installation. Particularly on boats adjustment is very desirable because manufacturing tolerances in the panel and boat deck or other components with which the panel is associated, may adversely impact sliding of the door, and either make the sliding difficult, or make it so that a good seal (and substantially a water-tight seal) is difficult or impossible to achieve. Also, it is highly desirable to be able to remove the panel after installation, for replacement or servicing, without having to remove the tracks.

According to the present invention a system, assembly, and method are provided that greatly facilitate adjustment of a sliding panel with respect to the tracks with which it is associated, and are particularly desirable for use with a companionway door or the like on a boat. By practicing the present invention it is possible to adjust the sliding panel, such as a companionway door, after installation so that it effectively slides with respect to the track, and seals. Also, according to the invention it is possible to readily remove the panel after installation, for replacement or servicing, simply by loosening a few screws.

According to one aspect of the present invention there is provided a track system for adjustably mounting a movable panel to a stationary track, comprising: At least one stationary track having a slide block or wheel-receiving channel and elongated in a first dimension. At least one adjustable slide block or wheel assembly comprising a slide block or wheel, and a panel mounting element, the position of the slide block or wheel with respect to the panel mounting element being adjustable in a second dimension non-aligned with the first dimension. A panel mounted by the panel mounting element. And the slide block or wheel received by the track channel.

Typically the second dimension is substantially transverse to the first dimension, and desirably the track is mounted on a boat, although it can be mounted elsewhere, and the second dimension it may be not specifically transverse, or may even be at a distinct angle with respect to the first dimension. While the invention is specifically described herein as utilizing one or more slide blocks, which are preferred, in some circumstances wheels (which includes rollers) may be used instead of slide blocks.

Typically, the at least one adjustable slide block assembly comprises first and second slide block assemblies; and the panel comprises a first substantially horizontal edge; and the first and second slide block assemblies are mounted to the panel adjacent the first substantially horizontal edge with the slide blocks thereof received by the channel. Also, typically the at least one track comprises first and second tracks vertically spaced from each other, and substantially parallel to each other; and the at least one adjustable slide block assembly comprises first, second, third and fourth slide block assemblies; and the panel comprises a second substantially horizontal edge substantially parallel to the first edge; and the fourth and third slide block assemblies are mounted to the panel adjacent the second substantially horizontal edge with the slide blocks thereof received by the second track channel. Also, each of the tracks may include a screen-receiving channel, and the screen-receiving channels may receive a screen for slidable movement with respect thereto.

Typically, each of the slide block assemblies includes: An adjuster track including a nut-receiving channel, the adjuster track connected to the slide block; an elongated substantially rectangular prism nut received in the nut-receiving channel; a plurality of guide surfaces on the panel mounting element, and cooperating guide surfaces on the adjuster track so that the adjuster track is slidable with respect to the panel mounting element and nut substantially in the second dimension; and a screw engaging the nut and movable from a tightened position in which the adjuster track is prevented from moving with respect to the panel mounting element in the second dimension, and an adjusting position in which the adjuster track can be moved with respect to the panel mounting element in the second dimension. For example, the tracks, adjuster tracks, nuts, and panel mounting elements, are metal (e.g. aluminum), as are the screws (e.g. stainless steel); and the slide blocks are or are coated with self-lubricating plastic; and the panel is transparent or translucent. Typically the panel may be plastic, such as acrylic, but alternatively may be glass, metal, or other transparent or opaque materials, and desirably the panel-receiving element is connected to the panel by removable fasteners.

Also, the panel may comprise a notch formed in the panel for receipt of the slide block assembly, the notch including overrun corners and the panel mounting element devoid of rounded corners adjacent the panel overrun corners; and the panel receiving element comprises a pair of channel-shaped ends which receive the panel therein.

According to another aspect of the present invention a slide block assembly per se is provided, comprising: A slide block. A panel mounting element. An adjuster track including a nut-receiving channel, the adjuster track connected to the slide block. An elongated substantially rectangular prism nut received in the nut-receiving channel. A plurality of guide surfaces on the panel mounting element, and cooperating guide surfaces on the adjuster track so that the adjuster track is slidable with respect to the panel mounting element and nut to adjust the position of the panel mounting element with respect to the slide block. And a screw engaging the nut and movable from a tightened position in which the adjuster track is prevented from moving with respect to the panel mounting element, and an adjusting position in which the adjuster track can be moved with respect to the panel mounting element. The adjuster track is desirably connected to the slide blocks by removable fasteners. The details of the slide block assemblies may be as set forth above.

According to another aspect of the present invention there is provided a method of installing a slidable panel on a boat utilizing at least one adjustable slide block assembly comprising a slide block, and a panel mounting element, the method comprising: a) Mounting the panel to the panel mounting element. b) Placing the slide block in the channel of the track. c) Attaching at least one stationary track having a slide block-receiving channel and elongated in a first dimension to the boat. And d) adjusting the position of the slide block with respect to the panel mounting element in a second dimension non-aligned with the first dimension without moving or acting on the track, or disconnecting the panel from the panel mounting element, so that the slide block slides [or if a wheel, the wheel rolls] correctly with respect to the track. In the method a) and b) are preferably practiced off the boat, e.g. in a jig at a factory, and the assembly shipped to the boat location for installation.

Typically in the practice of the method c) is practiced by attaching two vertically spaced and substantially parallel tracks to the boat; and a)–d) are practiced using at least one slide block assembly associated with each track. Desirably a)–d) are practiced using at least two slide block assemblies with each track.

In one preferred embodiment, a)–d) are practiced using a companionway door as the panel. Further, preferably each slide block is operatively connected to a panel mounting element by a single screw and nut assembly; and the method further comprises e) loosening or removing substantially all of the screw and nut assemblies so that the companionway door may be removed from the boat for service or replacement without removing or disturbing the tracks.

According to the present invention a simple yet highly advantageous method and structures are provided which allow adjustment of a slidable panel with respect to a stationary track, and are particularly desirable for use with boats. This and other objects of the invention will become clear from an inspection of the detailed description of the invention and from the appended claims.

DETAILED DESCRIPTION OF THE DRAWINGS

Figure 1:
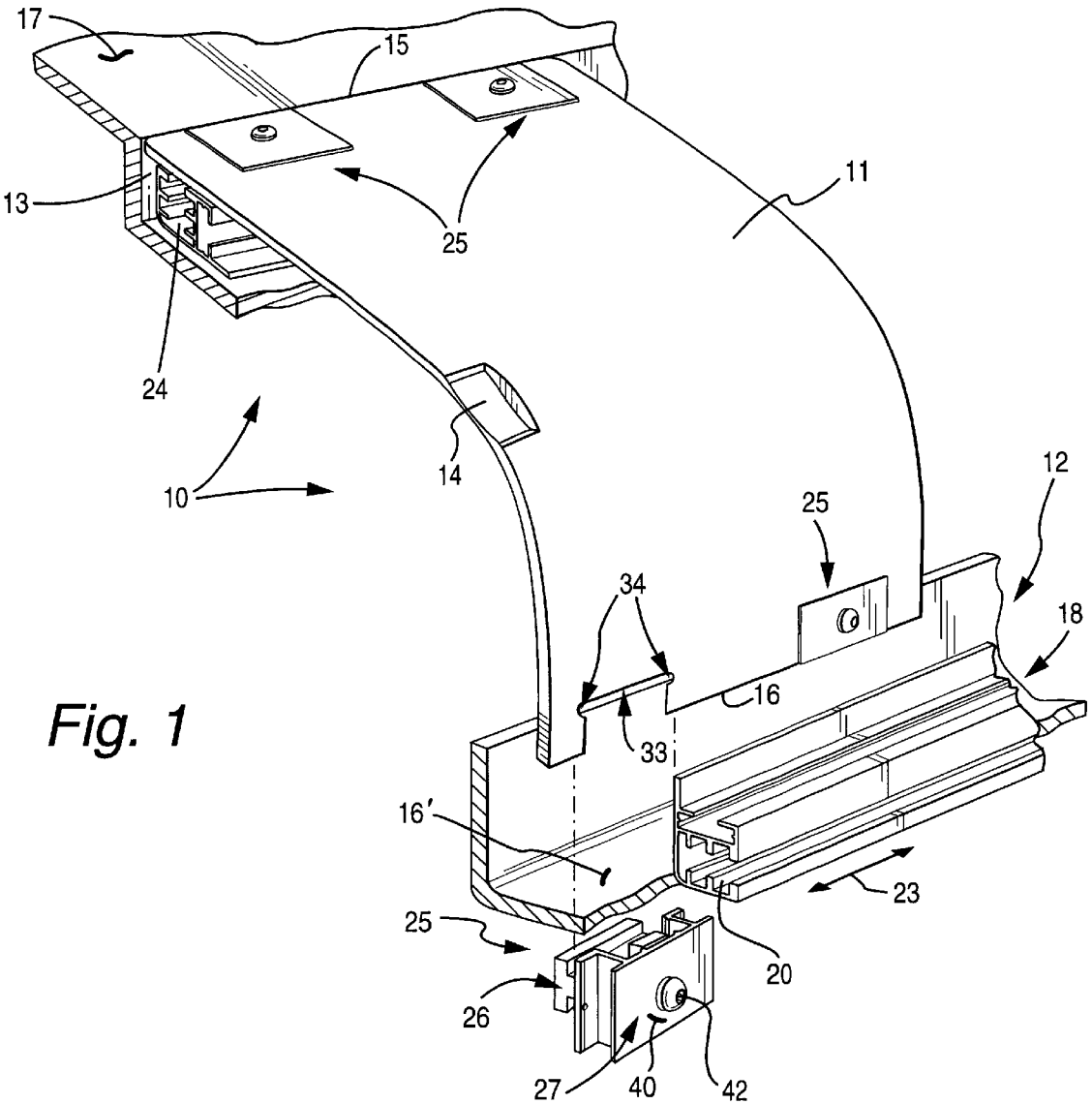
FIG. 1 is a schematic exploded perspective view of an exemplary track system according to the present invention.

Schematically and generally illustrated by reference 10 in FIG. 1 is an exemplary track system for adjustably mounting a movable panel 11 to a stationary track 12, 13, according to the present invention. The panel 11 may be any suitable element such as a window, door, hatch, or the like. In the preferred embodiment illustrated the panel 11 is a companionway door having a handle or hand grasping portion 14 at an intermediate portion thereof, and being curved from the top 15 to the bottom 16 thereof. The panel 11 may preferably be transparent or translucent, and typically may be made of a plastic material, such as acrylic. However, it is to be understood that the invention is also applicable to other types of panels and environments, including flat, otherwise contoured, and opaque panels 11.

In the preferred embodiment of the system 10 illustrated in FIG. 1, a system is mounted in association with a boat, a bottom portion (such as a deck or sill) of the boat being shown generally by reference numeral 16' in FIG. 1, and another component, such as a cabin wall, being schematically illustrated at 17 in FIG. 1. However, it is to be understood that the system 10 is useful with other types of structures than boat, however the adjustability features of the present invention are particularly desirable when employed with association with boats.

Figure 3:
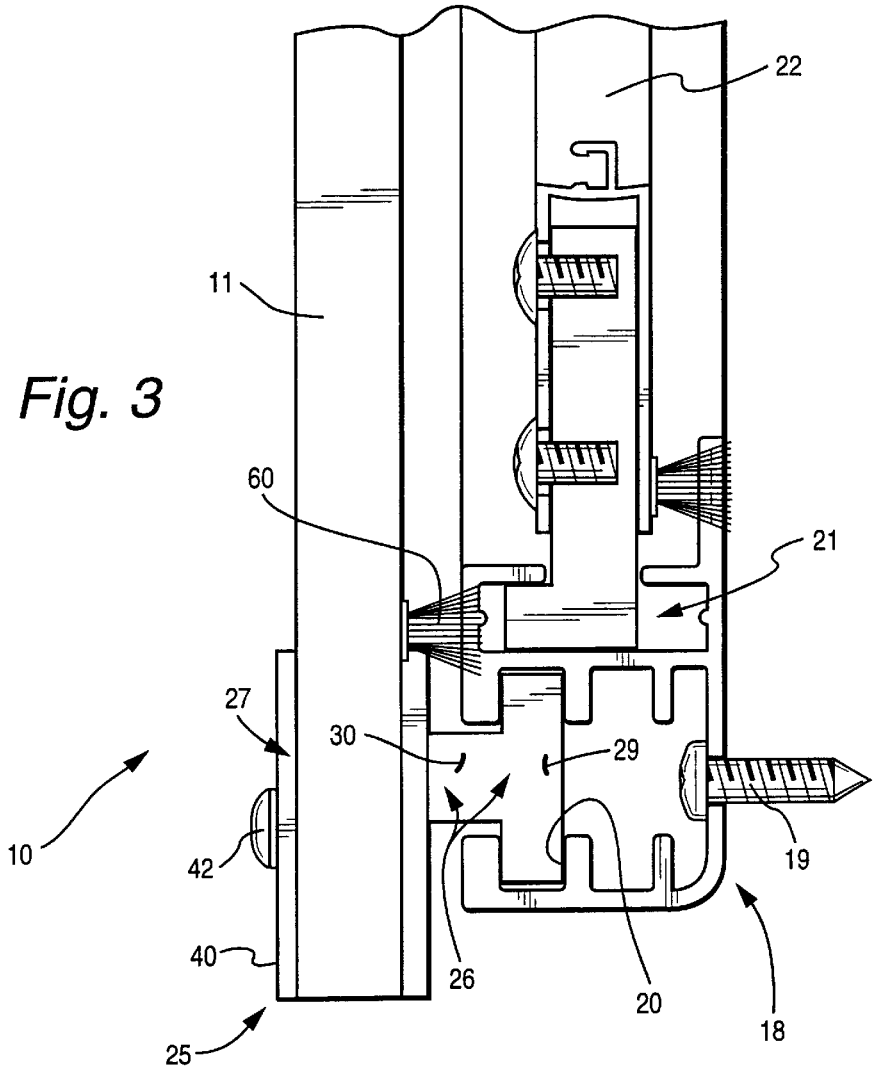
FIG. 3 is an end view of the bottom of the system of FIG. 1, and also shown in association with the use of a bug screen and sealing components.

The system 10 includes at least one track 18 which can be seen in FIGS. 1 and 3, which is affixed to the boat portion 16', such as by a plurality of fasteners 19 (see FIG. 3), adhesive, and/or other conventional fastening components. The track 18 preferably comprises an aluminum channel which is contoured depending upon the particular use thereof, but includes a slide block or wheel-receiving channel 20, and typically also a screen-receiving channel 21 in which a conventional screen 22 is slidable. The track 18 is elongated in a first dimension 23 (see FIG. 1) which preferably is substantially horizontal (that is, substantially parallel to a boat deck when used on a boat).

According to the present invention in a preferred form a second track 24 is provided which is substantially identical to the first track 18, and is mounted to the boat portion 17 or the like, vertically spaced from and substantially parallel to the first track 18. However, some other mechanism besides the substantially identical track 24 may be utilized with the panel 11 to facilitate sliding thereof especially where adjustment at the top 15 of the panel 11 is much less likely to be necessary, or under some circumstances with particularly large panels, and where the structure of the boat or other device with which the tracks 18, 24 are associated allows it, another track can be provided.

Figure 6:
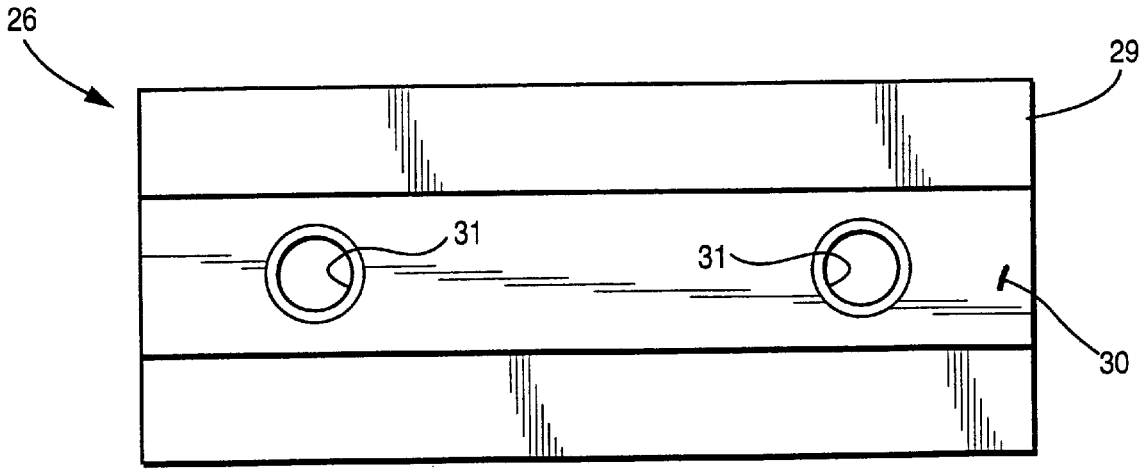
FIG. 6 is a rear view of the slide block of the slide block assembly of FIGS. 1 through 4.

According to the present invention at least one, and preferably a plurality of, adjustable slide block or wheel assemblies 25 are provided associated with the panel 11 and tracks 18, 24. [The invention will be particularly described with respect to slide blocks, but it is to be understood that wheels may be used instead.] Each slide block assembly 25 comprises a slide block 26 (see FIGS. 1 through 3 and 6) in a panel mounting element 27 (see FIGS. 1 through 4 and 8). Each slide block 26 typically is of, or is coated with, a low friction material, such as a self-lubricating plastic, e.g. polytetrafluoroethylene. [Where a wheel is provided it preferably is of metered or hard plastic and mounted on a ball bearing shaft.] Desirably the slide block 26 has the configuration illustrated in FIGS. 1 through 3 and 6 including an enlarged substantially rectangular prismatic portion 29 which is received in the channel 20, and a supporting substantially prismatic portion 30, so that the portions 29, 30 have a generally T-shape. One or more openings 31 (see FIGS. 2 and 6) may be provided for receipt of removable fasteners as will be hereinafter described. The openings 31 may be screw threaded or plain bore, depending upon the particular fasteners used and other considerations.

The panel mounting element 27 preferably is of aluminum or other another metal and is seen most clearly in FIGS. 1, 2, 4, and 8 preferably is dimensioned so that it fits within a notch 33 (see FIG. 2) cut out in an edge (the edge 16 seen in FIG. 1) of the panel 11. The notch 33 may be routed into the panel 11 (particularly when formed by an acrylic sheet) with the corner 34 thereof overrun so as to eliminate the necessity of rounding off the corners of the element 27 (the sharp, unrounded, comers of the element 27 being seen, for example, at 35 in FIG. 4), Preferably the element 27 has the configuration illustrated in FIGS. 4 and 8 having end surfaces which define channel-shaped openings 36 (see FIG. 4) with the surfaces 37 defining the sides of the channels 36 spaced from each other approximately the same distance as the thickness of the panel 11 at the edge 16. While if desired the panel 11 may be adhesively or otherwise permanently secured to the surfaces 37, or otherwise permanently secured in the channels 36, preferably attachment of the element 27 to the panel 11 is accomplished by a plurality of removable fasteners such as the screws 38 best seen in FIGS. 2 and 4, and with openings 39 for receipt of the screws seen in FIG. 8.

The element 27 also includes a front face 40 with an opening 41 therein (see FIG. 8 in particular) for receipt of a screw 42 (see FIGS. 1, 3 and 4 in particular) for purposes will be hereinafter described. The open interior 43 of the element 27 receives—in the preferred embodiment—an adjuster track 44 (in particular see FIGS. 4 and 5) for purposes that will be hereinafter described. At the interior 43, the element 27 also has a plurality of guide surfaces 46, seen in FIGS. 4 and 8. An optional primarily aesthetic panel 45 (e.g. of stainless steel) may also be utilized.

Regardless of the details of the mechanism utilized, the slide block 26 is adjustable in a second dimension which intersects the first dimension 23, with respect to the panel mounting element 27 and of course the panel 11 to which it is connected. While a wide variety of adjustment mechanisms may be utilized for this purpose, in the preferred embodiment illustrated in the drawings (which is inexpensive and easy to make, and very easy to utilize) the slide block 26 is secured to the adjuster track 44, and the track 44 slides within the open interior 43 of the panel mounting element 27.

The slide block 26 may be secured to the adjuster track 44 by removable fasteners, such as the fasteners 48 illustrated in 44 which extend into the openings 31. In the preferred embodiment the fasteners 48 are screws which are threaded into screw threaded openings 31. However, if desired the elements 26, 44 may be permanently secured together by welding, ultrasonic welding, adhesive, or the like. Note that the screws 48 pass through openings 49 formed in the front face 50 (see FIG. 5 in particular) of the adjuster track 44. A lock washer (not shown) may be provided with each screw 48.

The adjuster track 44 has an interior channel 51 (see FIG. 4) which is preferably open at the ends thereof, but is closed at one side by the face 50, and partially enclosed at the other side by the flanges 52. The flanges 52 are spaced from each other in dimension 23 a distance just large enough to accommodate the diameter of the fasteners 42, so that the fasteners 42 and channel 51 move with respect to each other in a second dimension 53 (see FIG. 2). While FIG. 2 shows the preferred second dimension 53, which is substantially transverse to the first dimension 23, the dimension 53 may have other angles besides substantially perpendicular to the dimension 23.

Figure 4:
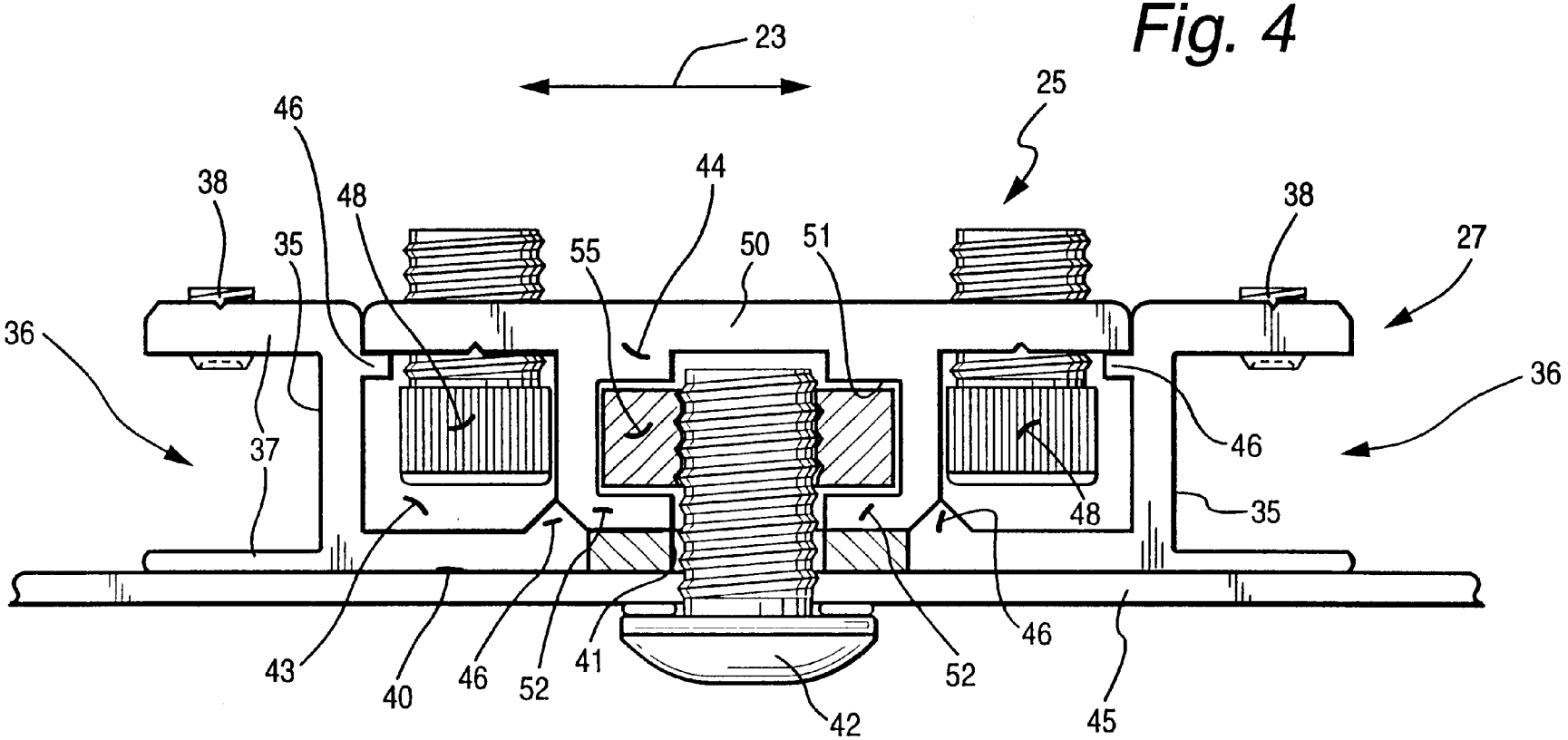
FIG. 4 is a top view, partly in cross section and partly in elevation, of an adjustable slide block assembly per se of the system of FIGS. 1 through 3.
Figure 5:
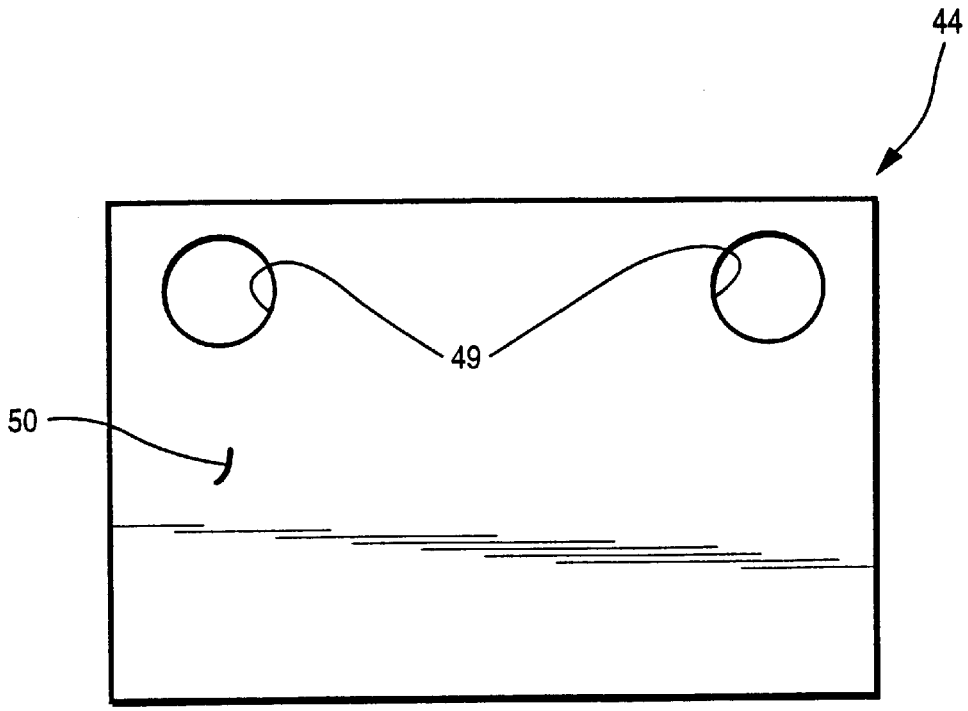
FIG. 5 is a front view of the adjuster track of a slide block assembly of FIGS. 1 through 5.
Figure 7:
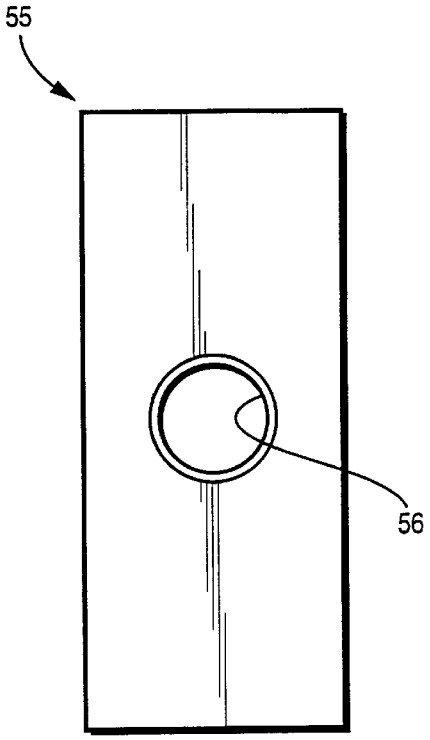
FIG. 7 is a front view of the adjuster nut of a slide block assembly of FIGS. 1 through 4.
Figure 8:
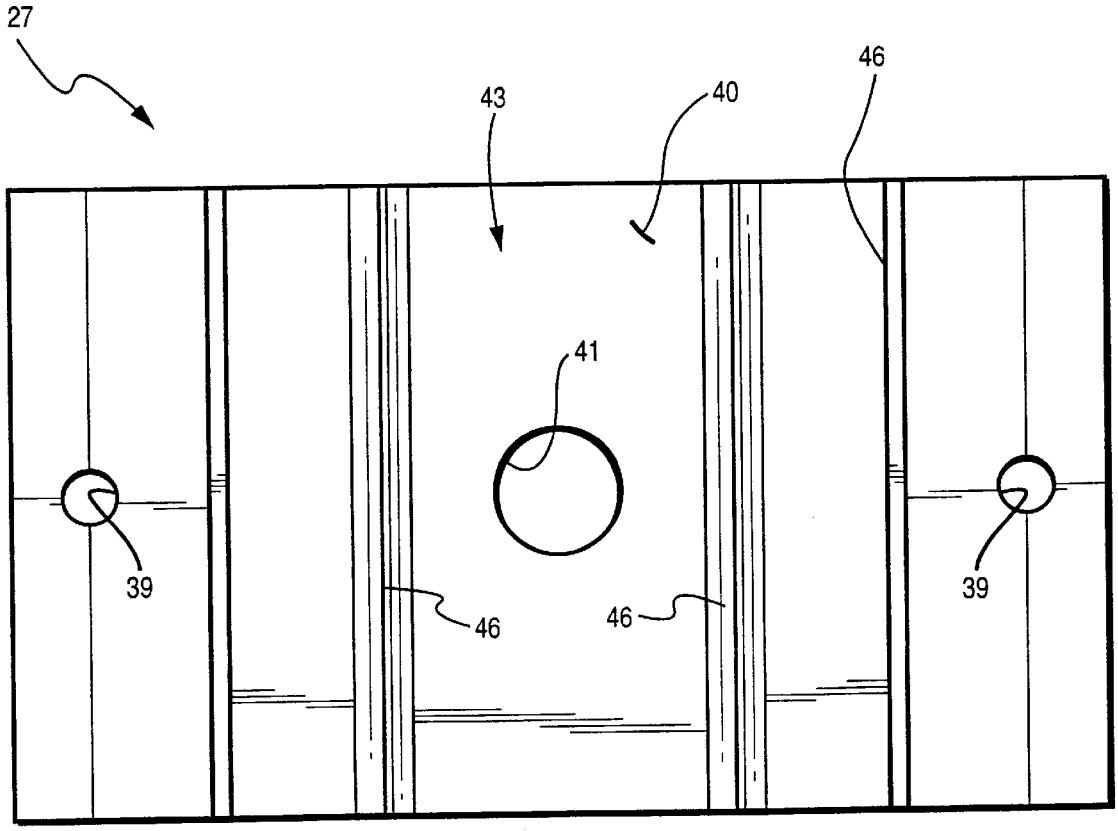
FIG. 8 is a rear view of panel mounting element of a slide block assembly of FIGS. 1 through 4.

The last component of the preferred embodiment of the adjustable side block assembly 25 illustrated in the drawings is the nut 55 which—as seen most clearly in FIGS. 4 and 7—has the central screw threaded opening 56 therein which receives the screw threaded shank of the screw 42. The nut 55 preferably has an elongated substantially rectangular prism configuration and is dimensioned so that it is just slightly smaller in cross sectional dimensions than the channel-shaped opening 51 so that it can slide with respect thereto. The nut 55 is elongated so that it won't fall to the bottom of the assembly if detached from screw 42, but will stay in alignment with screw 42.

Figure 2:
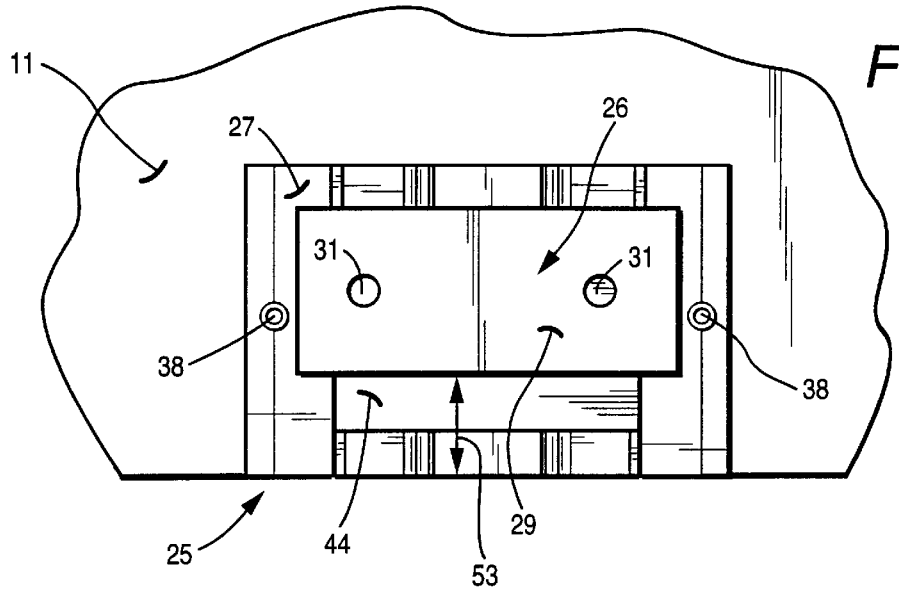
FIG. 2 is a rear detail view of an adjustable slide block assembly mounted to the panel for the configuration of FIG. 1, and showing the adjustment of the slide block with respect to the track.

In the method of assembly and utilization of the system 10 according to the invention, the screws 48 are passed through the openings 49 into the openings 31 of the slide blocks 26 and then the adjustable slide block assemblies 25 are assembled together, by inserting the nuts 55 into the channels 51, passing the screws 42 through the openings 41 into engagement with the threaded openings 56 in the nuts 55, and then sliding the adjuster tracks 44 into operative association with the channels 43 of the panel mounting elements 27, so as to form the structures as illustrated in FIGS. 1 and 2, and then the channel-shaped ends 36 of the elements 27 are moved into operative association with the portions of the panel 11 defining the notches 33. The screws 38 are then tightened to hold the panel 11 substantially stationary with respect to the channel-mounting elements 27.

Once all of the assemblies 25 are assembled with the panel 11, as illustrated in FIG. 1 (with the last assembly 25 also in place in the notch 33) the slide blocks 26 associated with the assemblies 25 are slid into the channels 20 of each of the tracks 18, 24 (see FIG. 3), and then the tracks 18, 24 are installed in the boat so that they are aligned in a first dimension 23.

Sliding action of the panel 11 with respect to the tracks 18, 24 is then tested to make sure that it is smooth and uniform, without binding, excessive noise, or excessive looseness. Also preferably a conventional seal of any type (such as the seal 60 illustrated in FIG. 3) is associated with the panel 11 and seals with respect to the tracks 18, 24 or a stationary portion of the boat, and the sufficiency of the sealing action by the seal 60 is also tested.

Under many circumstances it is necessary to adjust the position of the panel 11 in the dimension 53 so as to ensure that the sliding action and/or seal are appropriate. This is accomplished for a particular assembly 25 simply by loosening or removing the screw 42, which loosens the connection between the adjuster track 44 and the panel mounting element 27 to allow relative sliding thereof in the dimension 53, as schematically illustrated in FIG. 2. Once the desired adjusted position has been reached, the screw 42 is tightened so that it cooperates with the nut 55 to essentially clamp the adjuster track 44 to the panel mounting element 27 so that the adjuster track 44 may no longer slide (guided by the surfaces 46) in the dimension 53. Ultimately, when the proper adjustment has been achieved, a properly functioning sliding panel (such as a companionway door) 11 is provided.

If it is necessary to service or replace the panel 11, that is easily effected simply by loosening or removing the screws 42 (four in the illustration provided in FIG. 1, although more may be provided if more assemblies 25 are utilized). Then the panel 11 (e.g. with screws 42 and panel mounting element 27 still mounted thereto) may be removed, while the adjuster track and the slide block 26 remain with the tracks 18, 24. As can be seen it is easy to remove then reinstall the panel 11 without having to remove or disturb the tracks 18, 24.

It will thus be seen that according to the present invention a very simple yet effective track system for adjustably mounting a movable panel to a stationary track, and slide block assembly therefor, and method of installing the sliding panel on a boat, are provided. While the invention has been herein shown and described in what is presently conceived to be the most practical and preferred embodiment thereof it will be apparent to those of ordinary skill in the art that many modifications may be made therein within the scope of the invention, which scope is to be accorded the broadest interpretation of the appended claims so as to encompass all equivalent structures and methods.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A track system for adjustably mounting a movable panel to a stationary track, comprising:

at least one stationary track having a slide block or wheel-receiving channel and elongated in a first dimension;

at least one adjustable slide block or wheel assembly comprising a slide block or wheel, and a panel mounting element, the position of said slide block or wheel with respect to said panel mounting element being adjustable in a second dimension non-aligned with said first dimension, wherein said slide block or wheel is lockable to said panel mounting element via a locking means;

a panel mounted by said panel mounting element; and said slide block or wheel received by said track channel.

2. A track system as recited in claim 1 wherein said second dimension is substantially transverse to said first dimension.

3. A track system as recited in claim 2 wherein said track is mounted on a boat.

4. A track system as recited in claim 3 wherein said at least one adjustable slide block or wheel assembly comprises first and second slide block or wheel assemblies; and wherein said panel comprises a first substantially horizontal edge; and wherein said first and second slide block or wheel assemblies are mounted to said panel adjacent said first substantially horizontal edge with said slide blocks or wheels thereof received by said channel.

5. A track system as recited in claim 4 wherein said at least one track comprises first and second tracks vertically spaced from each other, and substantially parallel to each other; and wherein said at least one adjustable slide block or wheel assembly comprises first, second, third and fourth slide block or wheel assemblies; and wherein said panel comprises a second substantially horizontal edge substantially parallel to said first edge; and wherein said fourth and third slide block or wheel assemblies are mounted to said panel adjacent said second substantially horizontal edge with said slide blocks or wheels thereof received by said second track channel.

6. A track system as recited in claim 5 wherein said tracks each include a screen-receiving channel; and wherein said screen-receiving channels receive a screen for slidable movement with respect thereto.

7. A track system as recited in claim 5 wherein each of said slide block or wheel assemblies comprises slide block assemblies which include: an adjuster track including a nut-receiving channel, said adjuster track connected to said slide block; an elongated substantially rectangular prism nut received in said nut-receiving channel; a plurality of guide surfaces on said panel mounting element, and cooperating guide surfaces on said adjuster track so that said adjuster track is slidable with respect to said panel mounting element and nut in said second dimension; and a screw engaging said nut and movable from a tightened position in which said adjuster track is prevented from moving with respect to said panel mounting element in said second dimension, and an adjusting position in which said adjuster track can be moved with respect to said panel mounting element in said second dimension.

8. A track system as recited in claim 7 wherein said tracks, adjuster tracks, nuts, panel mounting elements, and screws are metal; and wherein said slide blocks are or are coated with self-lubricating plastic; and wherein said panel is transparent or translucent.

9. A track system as recited in claim 1 wherein said slide block or wheel assembly comprises a slide block assembly comprising: an adjuster track including a nut-receiving channel, said adjuster track connected to said slide block; an elongated substantially rectangular prism nut received in said nut-receiving channel; a plurality of guide surfaces on said panel mounting element, and cooperating guide surfaces on said adjuster track so that said adjuster track is slidable with respect to said panel mounting element and nut in said second dimension; and a screw engaging said nut and movable from a tightened position in which said adjuster track is prevented from moving with respect to said panel mounting element in said second dimension, and an adjusting position in which said adjuster track can be moved with respect to said panel mounting element in said second dimension.

10. A track system as recited in claim 9 wherein said track, adjuster track, nut, panel mounting element, and screw are metal; and wherein said slide blocks are self-lubricating plastic; and wherein said panel is transparent or translucent.

11. A track system as recited in claim 10 wherein said panel is plastic and wherein said panel-receiving element is connected to said panel by removable fasteners.

12. A track system as recited in claim 11 wherein said panel comprises a notch formed in said panel for receipt of said slide block assembly, said notch including overrun corners and said panel mounting element devoid of rounded corners adjacent said panel overrun corners; and wherein said panel receiving element comprises a pair of channel-shaped ends which receive said panel therein.

13. A track system as recited in claim 10 wherein said track is mounted on a boat.

14. A track system as recited in claim 13 wherein said at least one adjustable slide block assembly comprises first and second slide block assemblies; and wherein said panel comprises a first substantially horizontal edge; and wherein said first and second slide block assemblies are mounted to said panel adjacent said first substantially horizontal edge with said slide blocks thereof received by said channel.

15. A track system as recited in claim 9 wherein said panel is acrylic.

16. A track system as recited in claim 1, wherein said at least one adjustable slide block or wheel assembly further comprises an adjuster track that secures said slide block or wheel to said panel mounting element, and wherein said locking means comprises a lockable and releasable screw securing said adjuster track and said panel mounting element.

17. A slide block or wheel assembly comprising:

a slide block or wheel;

a panel mounting element;

an adjuster track including a nut-receiving channel, said adjuster track operatively connected to said slide block or wheel;

an elongated substantially rectangular prism nut received in said nut-receiving channel;

a plurality of guide surfaces on said panel mounting element, and cooperating guide surfaces on said adjuster track so that said adjuster track is slidable with respect to said panel mounting element and nut to adjust the position of said panel mounting element with respect to said slide block or wheel; and a screw engaging said nut and movable from a tightened position in which said adjuster track is prevented from moving with respect to said panel mounting element, and an adjusting position in which said adjuster track can be moved with respect to said panel mounting element.

18. An assembly as recited in claim 17 wherein said panel mounting element, adjuster track, and nut are aluminum, and wherein said slide block or wheel comprises a slide block of, or coated with, self-lubricating plastic.

19. An assembly as recited in claim 17 wherein said adjuster track is connected to said slide block by removable fasteners.

20. A method of installing a slidable panel on a boat utilizing at least one adjustable slide block assembly comprising a slide block or wheel, and a panel mounting element, said method comprising:

a) mounting the panel to the panel mounting element;

b) placing the slide block or wheel in the channel of the track;

c) attaching at least one stationary track having a slide block or wheel-receiving channel and elongated in a first dimension to the boat;

d) adjusting the position of the slide block or wheel with respect to the panel mounting element in a second dimension non-aligned with the first dimension without moving or acting on the track, or disconnecting the panel from the panel mounting element, so that the slide block slides or the wheel rolls correctly with respect to the track; and e) enabling the slide block or wheel to be locked with respect to the panel mounting element via a locking means.

21. A method as recited in claim 20 wherein c) is practiced by attaching two vertically spaced and substantially parallel tracks to the boat; and wherein a), b) and d) are practiced using at least one slide block or wheel assembly associated with each track.

22. A method as recited in claim 21 wherein a)–d) are practiced using a companionway door as the panel.

23. A method as recited in claim 22 wherein the slide blocks or wheels comprise slides blocks, and wherein each slide block is operatively connected to a panel mounting element by a single screw and nut assembly; and further comprising e) loosening or removing all of the screw and nut assemblies so that the companionway door may be removed from the boat for service or replacement without removing or disturbing the tracks.

24. A method as recited in claim 21 wherein a)–d) are practiced using at least two slide block or wheel assemblies with each track.

25. A track system for adjustably mounting a movable panel to a stationary track, comprising:

at least one stationary track having a slide block or wheel-receiving channel and elongated in a first dimension;

at least one adjustable slide block or wheel assembly comprising a slide block or wheel, and a panel mounting element, the position of said slide block or wheel with respect to said panel mounting element being adjustable in a second dimension non-aligned with said first dimension; wherein said slide block or wheel is lockable to said panel via a locking means;

a panel mounted by said panel mounting element, said panel comprising a notch formed therein, wherein said slide block or wheel assembly is secured in said notch in said panel; and said slide block or wheel received by said track channel.

* * * * *